United States Patent [19]

Krauser

[11] Patent Number: 4,484,542

[45] Date of Patent: Nov. 27, 1984

[54] FOUR-VALVE CYLINDER HEAD OF A FOUR-STROKE ENGINE

[75] Inventor: Michael Krauser, Germering, Fed. Rep. of Germany

[73] Assignee: Krauser KFZ-Zubehör Vertriebs-GmbH, Mering, Fed. Rep. of Germany

[21] Appl. No.: 370,121

[22] Filed: Apr. 20, 1982

[30] Foreign Application Priority Data

Apr. 28, 1981 [DE] Fed. Rep. of Germany ..... 3116802

[51] Int. Cl.[3] ..... F02P 1/06

[52] U.S. Cl. ..... 123/41.69; 123/193 H

[58] Field of Search ..... 123/41.69, 41.82, 193 R, 123/193 H, 308, 306, 315, 432

[56] References Cited

U.S. PATENT DOCUMENTS 2,725,045 11/1955 Flatz et al. ..... 123/41.69

FOREIGN PATENT DOCUMENTS 0233261 10/1944 Switzerland ..... 123/41.69

0699554 11/1953 United Kingdom ..... 123/41.69

*Primary Examiner*—Craig R. Feinberg

*Attorney, Agent, or Firm*—Michael J. Striker

[57] ABSTRACT

A four-valve cylinder head of a four-stroke engine has a body formed with an enlarged material cross-section portion located above a combustion chamber to increase heat exchange surface in the cylinder head. For cooling the cylinder head the latter is further formed with a straight passage receiving cooling air therethrough. The passage includes a central portion, a funnel-shaped portion communicating with the central portion, and a conical suction portion also communicating with the central portion. Cooling air is introduced into the interior of the head through the funnel-shaped portion and is sucked away through the conical suction portion.

3 Claims, 3 Drawing Figures

FOUR-VALVE CYLINDER HEAD OF A FOUR-STROKE ENGINE

BACKGROUND OF THE INVENTION

The invention relates in general to four-stroke engines. More particularly, the invention relates to a four-valve cylinder head for a four-stroke engine. Even more specifically, the invention relates to means for cooling the cylinder head of the four-stroke engine.

Four-stroke engines operated under intensive loads should have combustion chambers which must be as small as possible to ensure relatively compact ignition part of the motor and therefore small and thick flame path. However, if a combustion chamber is relatively small the heat-receiving surface is also relatively small; this results in substantial overheating of the engine.

SUMMARY OF THE INVENTION

It is an object of the invention to provide an improved cylinder head for a four-stroke engine.

It is a further object of the invention to provide efficient cooling means on a cylinder head of the four-stroke engine with a small compact combustion chamber, which cooling means will provide for very efficient heat exchange.

These and other objects of the invention are attained by a four-valve cylinder head, of a four-stroke engine, into which cooling air is introduced for cooling the cylinder head, comprising a head body; a combustion chamber positioned in a lower portion of said head body; and inlet at one side of said body and an outlet at the opposite side of said body; and means for cooling the cylinder head, and particularly the area above said combustion chamber, said cooling means comprising a portion of said body having an enlarged material cross-section and extended between said inlet and said outlet, and a straight passage for cooling air passing therethrough, said passage including a central enlarged portion, a funnel-shaped portion extended outwardly of said central portion towards the outlet side of the cylinder head, and a suction portion branched off of said central portion and being laterally offset of said funnel-shaped portion, cooling air being introduced into said funnel-shaped portion and sucked off away from the cylinder head through said suction portion.

The funnel shaped portion may be so formed that it is narrowed at the region of said enlarged portion and widens in outward direction.

As was mentioned above, the cylinder head according to the invention has, in the area above the combustion chamber, a portion with a relatively large material cross-section, which portion extends between the relatively cool inlet and the very hot outlet of the cylinder head to thereby form a relatively large heat-receiving surface and thus poovide for effective heat exchange between the portion of the cylinder head, extended upwardly of the combustion chamber, and the remaining part of the cylinder head. For cooling the cylinder head in general, and particularly for cooling the portion thereof having an enlarged material cross-section, a straightly extending passage is provided, which is formed above said enlarged portion and extends between the inlet and the outlet of the cylinder head. This passage includes, at the outlet side of the head, as defined in the direction of air travel, a narrowing funnel-shaped dynamic air pressure chamber or space. This funnel-shaped chamber is narrowed in the interior of the cylinder head, in the area thereof where a spark plug is inserted into the cylinder head, and is widened in outward direction. In addition, a relatively small opening is formed in the straightly extended passage between the cooling fins formed at the inlet and the outlet sides of the cylinder head. That straight passage further includes a suction passage or opening which is branched off of the above mentioned central portion formed somewhat at the level of spark plug; this branched off suction opening is conically widened in outward direction.

During air travel in the cylinder and via air stream introduced at the front of the cylinder, cooling air is pressed into the interior of the cylinder head through said funnel-shaped portion or dynamic air pressure chamber formed above the outlet of the cylinder head; a relatively small portion of the cooling air is discharged through the very small opening at the inlet side of the head. Simultaneously compressed air in the interior of the cylinder head is sucked off from that interior via a laterally positioned suction passage branched off from the enlarged central portion of the air passage. This suction-off effect is known in the art as a "Venturi-nozzle effect." Accordingly, a very effective air travel through the cylinder head may be obtained. Along with cooling the interior of the cylinder head the cooling of the spark plug is achieved.

For improving the cooling of the cylinder head the latter is provided with additional cooling fins formed at the intensively heated outlet side of the head. The cooling fins formed at the outlet side of the cylinder head may be substantially deeper than the cooling fins formed at the relatively cold inlet side of the cylinder head.

Due to the provision of the cylinder head with cooling means according to the invention very efficient heat exchange is provided. This heat exchange is obtained owing to the enlarged portion of greater material cross-section and due to the funnel-shaped structure of the air passage formed above the outlet, which passage substantially accelerates cooling air flow through the interior of the cylinder head and thus improves heat transition. This cooling air action is further strengthened by air stream generated by air suction through the lateral suction opening and by the cooling fins provided at the inlet and outlet sides of the cylinder head whereby very effective material heat exchange is provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
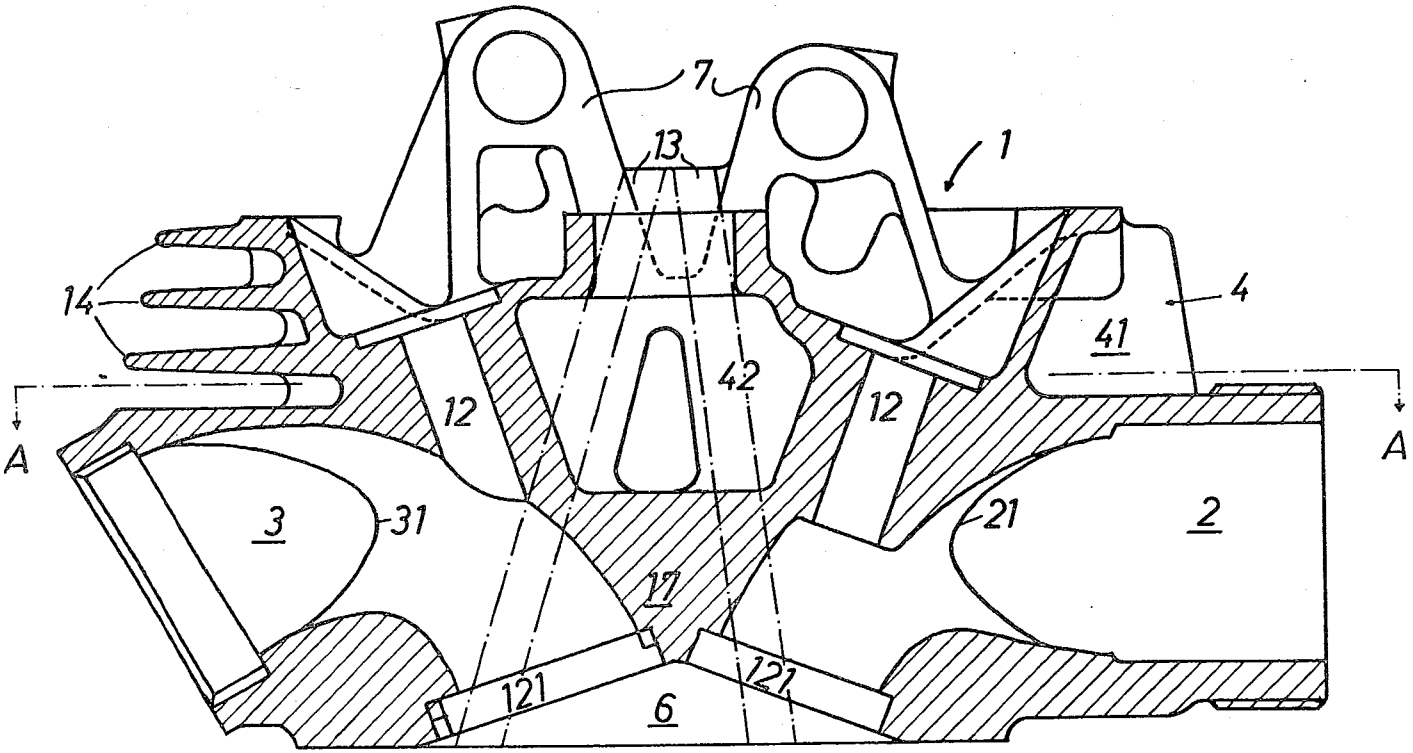
FIG. 1 is a sectional central view through a cylinder head according to the invention.

Referring now to the drawings, and first to FIG. 1 thereof, a left-side cylinder head 1 for a four-stroke double-piston engine is shown with a downwardly positioned cam shaft (not shown and known in the art). Bearing frames 7 disposed in the upper part of the cylinder head serve for supporting tilting forked levers (also known and not illustrated herein) for two inlet valves and two outlet valves which, through the respective plungers guided in bores 13 (shown by dash-dot lines), relatively short plunger rods thereof, and further plungers (not shown), operate the cam-shaft located below the cylinder head. Bores 12 and respective valve seats 121 serve for the valves. Valve seats 121 are positioned above a combustion chamber 6. An inlet of the cylinder head is denoted by reference character 3 whereas its outlet is designated by reference numeral 2. A fork-shaped channel 31 is formed at the inlet side of the head and a fork-shaped channel 21 is formed at the outlet side of the cylinder head.

According to the invention a cross-section of the material of the cylinder head, extending between the inlet 3 and the outlet 2, is substantially larger than that of conventional cylinder heads. This results in a larger heat-receiving surface and thus in very effective heat exchange between the relatively cool inlet side 3 and the very hot outlet side 2. As seen in FIG. 1, a passage 4 is formed above the outlet 2, which passage includes a funnel-shaped dynamic air pressure chamber 41 and an enlarged central portion 42 at the engine block side also seen in FIG. 3. Relatively short cooling fins are formed above the inlet 3 at the inlet side of the cylinder head and longer or deeper cooling fins 15 are provided at the outlet side of the head of the cylinder.

Figure 2:
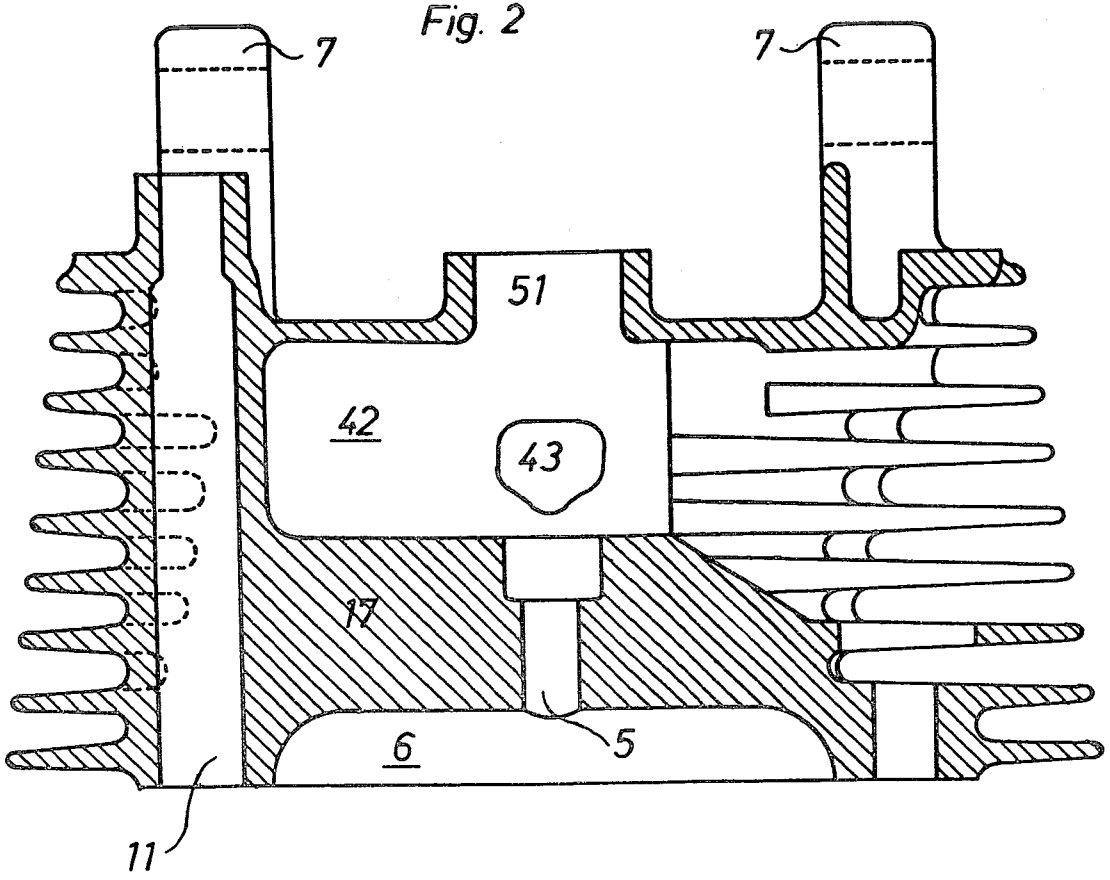
FIG. 2 is a view extending somewhat perpendicular to the section shown in FIG. 1.

With reference to FIG. 2 showing a section through the cylinder head extending somewhat perpendicular to the section illustrated in FIG. 1, it can be seen that a small exhaust opening 43 of the passage 4 is provided at the inlet side of the head.

A stepped bore 5 extends from the enlarged central portion 42 of passage 4 into the combustion chamber 6. An inlet opening 51 formed in the central portion 42 serves for receiving a spark plug inserted from above, which spark plug is to be extended through the bore 5 into the combustion chamber 6, with its ignition electrode. The stepped bore 5 for receiving the spark plug therethrough projects through the portion 17 of the greater cross-section of the material. A bore 11 provided in the cylinder head serves for receiving fastening bolts therein.

Figure 3:
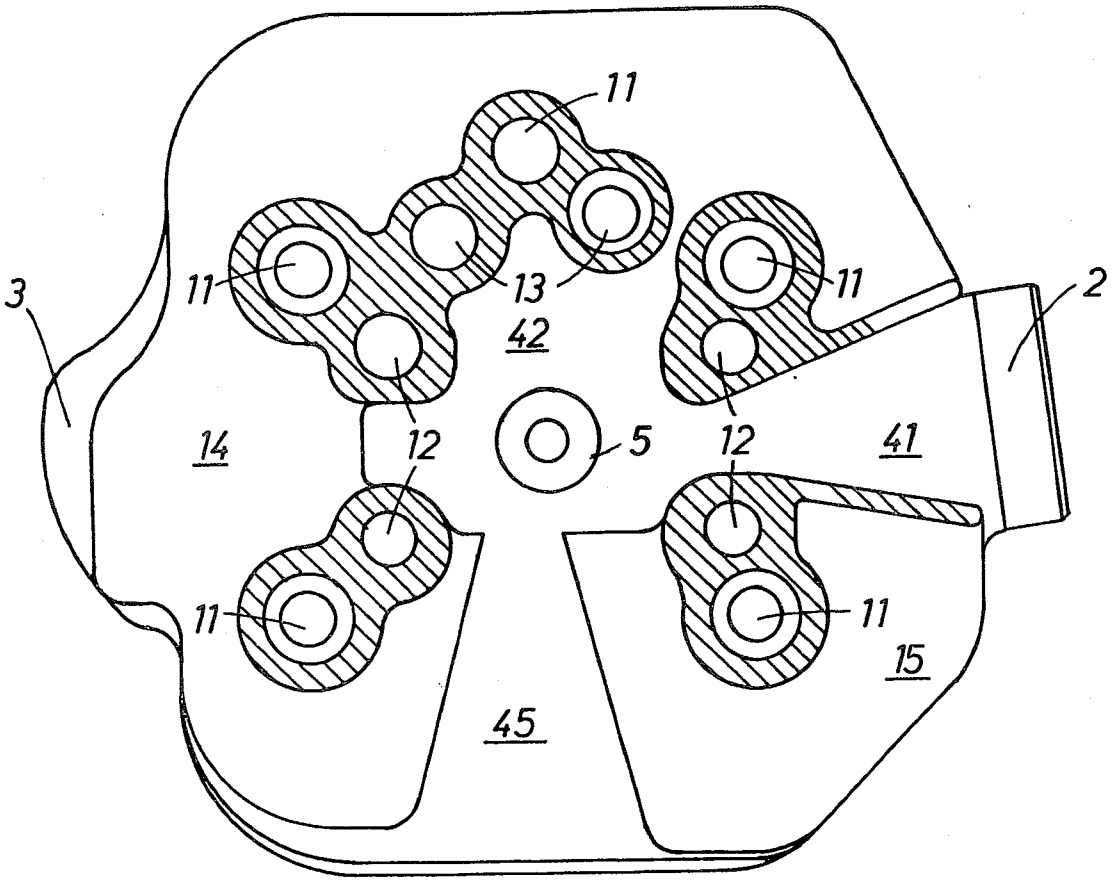
FIG. 3 is a sectional view taken along line A—A of FIG. 1.

FIG. 3 depicts the section taken on line A—A of FIG. 1. As seen from FIG. 3 the funnel-like dynamic air pressure chamber 41 of passage 4, provided above the outlet 2 is so formed that it is narrowed in the region of central portion 42 and widens in outward direction. Central portion 42 is further branched off into a conically widening lateral suction passage or opening 45 extended outwardly from portion 42 and facing away from the engine block side. A plurality of stepped bores 11 for receiving respective fastening bolts are formed in the head of the cylinder. Bores 12 for guiding the valves as well as bores 13 for guiding the plungers are shown in FIG. 3.

Although the invention has been explained herein in relation to a four-stroke double-piston engine with a cam shaft positioned below the head of the cylinder it is to be understood that the cylinder head of the invention is not limited to such an engine. For example, such cylinder head may be used in a right-side cylinder with a cam shaft disposed above the cylinder head.

It will be understood that each of the elements described above, or two or more together, may also find a useful application in other types of four-valve cylinder heads differing from the types described above.

While the invention has been illustrated and described as embodied in a four-valve cylinder head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a four-valve cylinder head of a four-stroke engine into which cooling air is introduced for cooling the cylinder head, comprising a head body receiving a spark plug; a combustion chamber in a lower part of said head body; an inlet at one side of said body and an outlet at an opposite side of said body; and a straight passage for cooling air passing therethrough and extended between the inlet side and the outlet side, said passage including an enlarged central portion and a funnel-shaped lateral portion connected to said central portion and extended outwardly therefrom towards the outlet side, the improvement comprising a suction portion branched off said central portion and being laterally offset of said funnel-shaped portion, said suction portion being conical and widening in an outward direction substantially perpendicular to said passage between the inlet side and the outlet side and extending outward from a level at which said spark plug is inserted into said body, cooling air being introduced into said funnel-shaped portion and sucked away from the cylinder head through said suction portion.

2. The cylinder head as defined in claim 1, wherein said funnel-shaped portion is narrowed at the region of said enlarged portion and widens in outward direction.

3. The cylinder head as defined in claim 2, wherein said funnel-shaped portion is positioned above said outlet.

* * * * *